US007494262B2

(12) United States Patent
Runions et al.

(10) Patent No.: US 7,494,262 B2
(45) Date of Patent: Feb. 24, 2009

(54) HALOGEN BURNER AND RECEPTACLE ASSEMBLY

(75) Inventors: Alton E. Runions, Springfield, IL (US); James H. Chambers, Springfield, IL (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/800,285

(22) Filed: May 4, 2007

(65) Prior Publication Data

US 2008/0273343 A1 Nov. 6, 2008

(51) Int. Cl.
*H01R 33/00* (2006.01)

(52) U.S. Cl. ..... 362/656; 362/548; 362/652

(58) Field of Classification Search ..... 362/263, 362/457, 458, 548, 549, 647, 649, 651, 652, 362/655, 656; 313/318.01, 318.07, 318.1, 313/318.12, 318.09

See application file for complete search history.

(56) References Cited

U.S. PATENT DOCUMENTS 2,191,336 A * 2/1940 Carroll ..... 362/390
4,547,838 A * 10/1985 Wakimizu ..... 313/318.09
4,763,038 A * 8/1988 Takayama ..... 313/318.07
4,864,183 A * 9/1989 Okano ..... 313/318.01
5,229,683 A * 7/1993 Eckhardt et al. ..... 313/318.07
5,239,226 A * 8/1993 Seredich et al. ..... 362/652
5,695,367 A * 12/1997 Takano et al. ..... 313/318.1
6,628,081 B2 * 9/2003 Behr et al. ..... 362/549
2004/0120145 A1 6/2004 Damm et al.

FOREIGN PATENT DOCUMENTS

EP 0821400 A2 1/1998
EP 1691129 A2 8/2006
WO WO 2006/016314 A1 2/2006

* cited by examiner

*Primary Examiner*—Y My Quach Lee
(74) *Attorney, Agent, or Firm*—Luis M. Ortiz; Kermit D. Lopez; William B. Shelby

(57) ABSTRACT

A bulb retainer device for use with bulbs such as halogen burner bulbs on vehicles subject to vibration and oscillation. The bulb has a flat burner glass press area and a receptacle is used for mounting the bulb in position to function as a light. A one piece metal sheet bulb retainer is mounted on the receptacle. The retainer has a circular drawn cup in its surface for slidably mounting the retainer on the receptacle. The retainer further has a plurality of arcuate fingers in the cup and sized to engage the bulb flat burner glass press area to restrain movement thereof. The preferred number of fingers is four and the retainer is fixedly mounted on the retainer after assembly.

18 Claims, 3 Drawing Sheets

HALOGEN BURNER AND RECEPTACLE ASSEMBLY

FIELD OF THE INVENTION

The present invention relates to halogen burners used on vehicles. More particularly, the invention relates to a halogen burner and receptacle assembly that prevents flexing of burner leads and thus avoids work hardened lead fractures.

BACKGROUND OF THE INVENTION

Operation of ATVs (All Terrain Vehicles) and other rough terrain traveling vehicles causes mechanical shock and vibrations which cause parts such as halogen burner assemblies to oscillate. In a normal horizontal burner filament orientation, up and down axis- and side-to-side axis oscillations flex the burner leads and cause them to work harden. In what is considered to be too short a time, the work hardened leads develop lead fractures, which, of course, severs the electrical circuit. When this happens at night, for example in the woods, the operator is subjected to unacceptable operating conditions.

The halogen burner glass wall has an inherent high in-use temperature which requires it to be positioned with adequate clearance from the thermoplastic receptacle. A temperature resistant one-piece metal retainer and the burner's metal lead wires are used to join the two components and maintain lower receptacle in-use temperature compared to the burner wall temperature.

It has been found that the halogen burner elements will oscillate in all three axes, up-and-down, side-to side, and front-to-back. Until now, there has not been an effective halogen burner and receptacle assembly that can eliminate all of these oscillations.

It would be of advantage in the art if a device could be provided that would substantially reduce or eliminate lead oscillation and thus extend the life of halogen burners used in headlights.

Yet another advantage would be if a receptacle could eliminate oscillation in up-and-down, side-to side, and front-to-back axes.

It would be another advance in the art if a halogen burner receptacle could be developed that is simple, easy to install and low in cost, while still being capable of reducing halogen bulb oscillation and prolonging the life of the bulb.

Other advantages will appear hereinafter.

SUMMARY OF THE INVENTION

It has now been discovered that the above and other advantages of the present invention may be obtained in the following manner. Specifically, the present invention provides a one-piece metal retainer that is attached to the flattened burner glass press area and to the receptacle. This retainer thus adds rigidity to the assembly and resists excessive burner oscillating excursion. The burn leads remain intact and electrical continuity is maintained to the burner filaments. Accordingly, the burner filaments are held in their desired location and orientation to produce the desired light output within a lamp system.

The burner retention device of this invention is formed as a one-piece bulb retainer. The retainer of this invention is formed as a circular drawn cup with slots along the side to orient the retainer radially to the receptacle. The device also includes a plurality of fingers, preferably four, that are sheared and formed from the top. flat drawn surface.

The plurality of fingers grip the burner press area with a friction fit. Their shape and dimension are such that they grip the thinnest burner press dimension with adequate force but they also yield to allow the thickest burner press dimension to be assembled.

BRIEF DESCRIPTION OF THE DRAWINGS

For a more complete understanding of the invention, reference is hereby made to the drawings, wherein like numbers refer to like elements, and in which.

DETAILED DESCRIPTION OF THE PREFERRED EMBODIMENT

Figure 1:
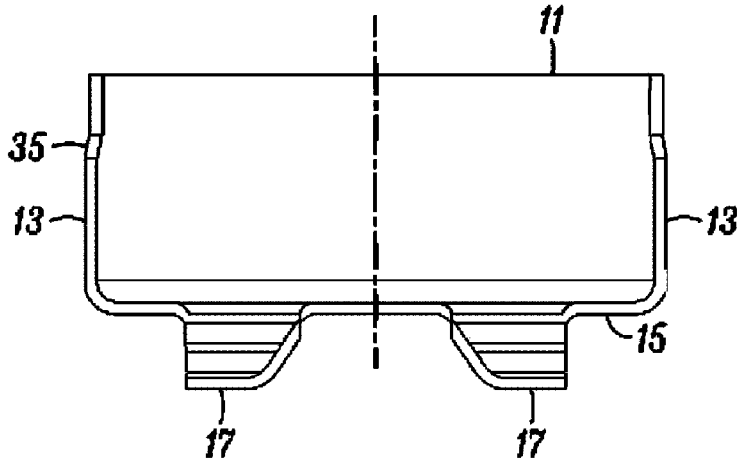
FIG. 1 is a side elevational view of the device of this invention.
Figure 2:
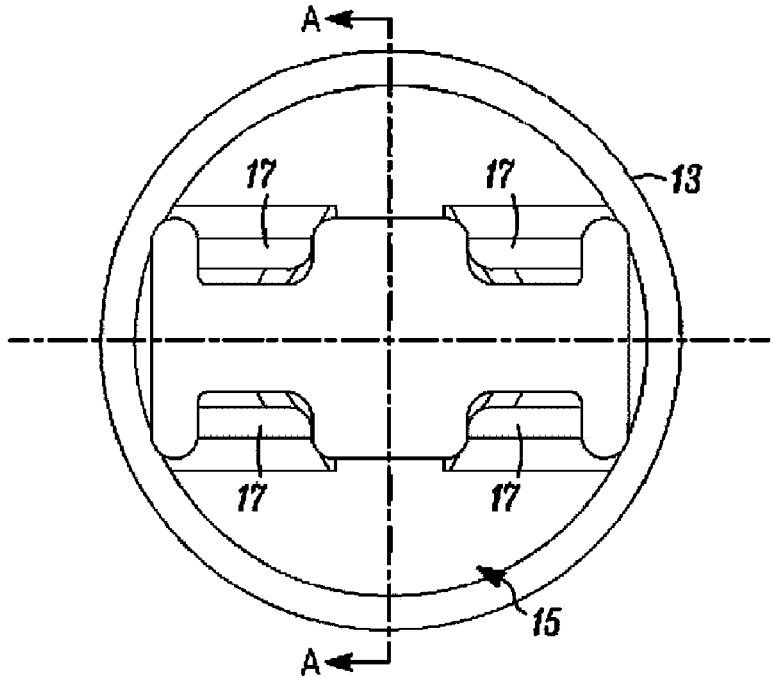
FIG. 2 is a bottom view of the device of FIG. 1.
Figure 3:
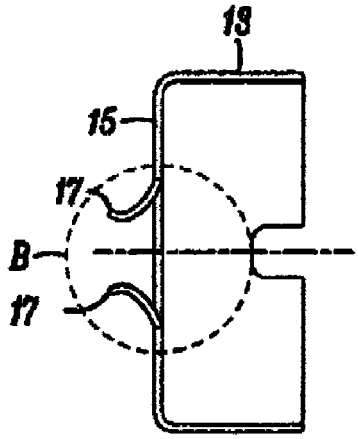
FIG. 3 is a sectional view taken along line A-A of FIG. 2.
Figure 4:
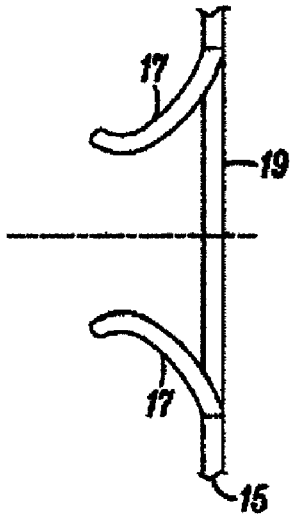
FIG. 4 is a detail view of the area in the B circle in FIG. 3.

The present invention provides for substantial improvements in mounting halogen burner bulbs and the like. The retainer 11 in FIGS. 1 and 2 is cup-shaped with sides 13 and top 15. A plurality of fingers 17 extend out from top 15, as seen best in FIG. 3. Fingers 17 are curved and arcuate, and extend out from top 15 to form, in this case of four fingers, a four point prong arrangement. The enlarged segment shown in FIG. 4 illustrates the opening 19 and two of the fingers 17, which portion of retainer 11 fits over the burner press area along with a receptacle that normally holds the bulb.

Figure 5:
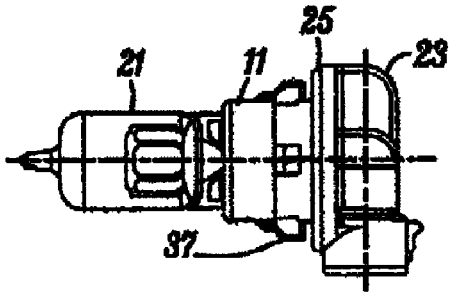
FIG. 5 is a side elevational view of the device of FIG. 1 in place with a halogen burner bulb.
Figure 6:
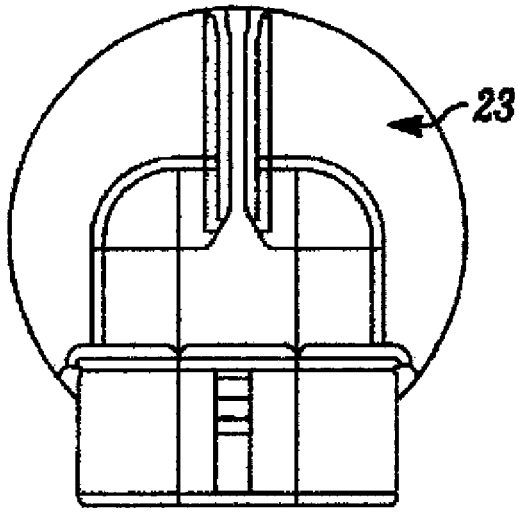
FIG. 6 is an end view of the device in FIG. 5.

FIG. 5 illustrates the bulb 21 installed in receptacle 23. A gasket 25 is place between receptacle 23 and retainer 11.

The shape and dimension of fingers 17 is such that they grip bulb 21 at the burner press area with a friction fit, exerting adequate force on the thinnest burner press dimension and yielding to allow the thickest burner press dimension to be assembled and also provide containment.

Figure 7:
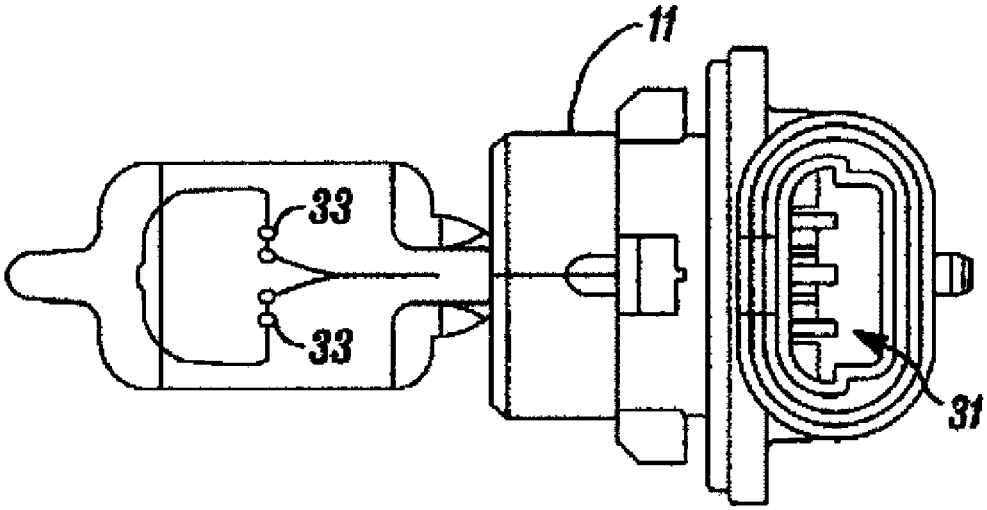
FIG. 7 is a partially cut-away view of the device of FIG. 5, illustrating the internal parts of the bulb and leads thereto.

The present invention uses the integral burner leads for positioning and retention functions as well as providing electrical current to the filaments. However, the leads alone are not of sufficient strength to function as the sole burner retention device, and an additional retention device is employed. The grip of fingers 17 on bulb 21 stabilizes the bulb 21, and prevents movement of leads 31 shown in FIG. 7 and keeps filaments 33 from being vibrated or oscillated.

As seen in FIG. 1, side slots 35 along the sides 13 of the cup to orient the retainer 11 with respect to receptacle 23. In this manner the bulb will be fixed in position so that filaments 33 are properly aligned. After assembly, the retainer 11 is permanently affixed at its position on the receptacle 23 with pin stakes 37.

While particular embodiments of the present invention have been illustrated and described, it is not intended to limit the invention, except as defined by the following claims.

The invention claimed is:

1. A bulb retainer device for use with bulbs on vehicles subject to vibration and oscillation, comprising:

a circular drawn cup;

a flat surface face on a top of said circular drawn cup; and a plurality of arcuate fingers disposed on said flat surface face wherein said plurality of arcuate fingers extend upward from said flat surface face forming an area sized to engage a bulb between said plurality of arcuate fingers and wherein said arcuate fingers curve outward away from said area sized to engage said bulb and whereby said plurality of fingers retain said bulb with a friction fit, thereby forming a bulb retaining device for resisting oscillation of said bulb.

2. The device of claim 1, wherein said bulb is a halogen burner.

3. The device of claim 1, wherein said circular drawn cup includes slots along the sides of said cup to orient said circular drawn cup radially to a receptacle.

4. The device of claim 3, wherein said circular drawn cup is fixedly mounted on said receptacle after assembly thereon.

5. The device of claim 4, wherein said circular drawn cup is mounted using pin stakes.

6. The device of claim 1, wherein said plurality of arcuate fingers comprises four fingers equally spaced about said flat surface face.

7. A bulb retainer device for use with bulbs on vehicles subject to vibration and oscillation, comprising:

a circular drawn cup;

a flat surface face on a top of said circular drawn cup; and a plurality of arcuate fingers disposed on and formed from said flat surface face wherein said plurality of arcuate fingers extend upward from said flat surface face forming an area sized to engage a bulb between said plurality of arcuate fingers and wherein said arcuate fingers curve outward away from said area sized to engage said bulb and whereby said plurality of fingers retain said bulb with a friction fit upon a flat burner glass press area of said bulb, thereby forming a bulb retaining device for resisting oscillation of said bulb.

8. The device of claim 7, wherein said bulb is a halogen burner.

9. The device of claim 7, wherein said circular drawn cup circular drawn cup to a receptacle and is fixedly mounted on said receptacle after assembly thereon.

10. The device of claim 7, wherein said circular drawn cup is fixedly mounted on said receptacle after assembly thereon.

11. The device of claim 10, wherein said circular drawn cup is mounted using pin stakes.

12. The device of claim 7, wherein said plurality of arcuate finger means comprises four fingers equally spaced about said flat surface face.

13. A method of retaining bulbs on vehicles subject to vibration and oscillation, comprising the steps of:

forming a one piece metal sheet bulb retainer mounted on a receptacle, said retainer comprising a circular drawn cup in its surface;

forming a flat surface face on a top of said circular drawn cup; and forming a plurality of arcuate fingers disposed on said flat surface face wherein said plurality of arcuate fingers extend upward from said flat surface face forming an area sized to engage a bulb between said plurality of arcuate fingers and wherein said arcuate fingers curve outward away from said area sized to engage said bulb and whereby said plurality of fingers retain said bulb with a friction fit upon a flat burner glass press area of said bulb, thereby forming a bulb retaining device for resisting oscillation of said bulb.

14. The method of claim 13, wherein said bulb is a halogen burner.

15. The method of claim 13, wherein said one piece metal sheet bulb retainer includes slots along the sides of said circular drawn cup to orient said retainer radially to said receptacle.

16. The method of claim 15, wherein said retainer is fixedly mounted on said receptacle after assembly thereon.

17. The method of claim 16, wherein said retainer is mounted using pin stakes.

18. The method of claim 13, wherein said plurality of arcuate fingers comprises four fingers equally spaced about said flat surface face.

* * * * *

UNITED STATES PATENT AND TRADEMARK OFFICE

CERTIFICATE OF CORRECTION

PATENT NO. : 7,494,262 B2
APPLICATION NO. : 11/800285
DATED : February 24, 2009
INVENTOR(S) : Alton E. Runions et al.

It is certified that error appears in the above-identified patent and that said Letters Patent is hereby corrected as shown below:

In Column 3, line 37, before “to” add --radially--;
In Column 4, line 37, delete “said” and add --a--.

Signed and Sealed this

Fourteenth Day of April, 2009

JOHN DOLL
*Acting Director of the United States Patent and Trademark Office*